US011589614B2

(12) United States Patent
Kaufman et al.

(10) Patent No.: US 11,589,614 B2
(45) Date of Patent: Feb. 28, 2023

(54) CARTRIDGE FOR USE WITH APPARATUS FOR HEATING SMOKABLE MATERIAL

(71) Applicant: BRITISH AMERICAN TOBACCO (INVESTMENTS) LIMITED, London (GB)

(72) Inventors: Duane A. Kaufman, Hollandale, WI (US); Raymond J. Robey, Madison, WI (US); Benjamin J. Paprocki, Cottage Grove, WI (US)

(73) Assignee: Nicoventures Trading Limited, London (GB)

( * ) Notice: Subject to any disclaimer, the term of this patent is extended or adjusted under 35 U.S.C. 154(b) by 482 days.

(21) Appl. No.: 15/754,834

(22) PCT Filed: Aug. 26, 2016

(86) PCT No.: PCT/EP2016/070190
§ 371 (c)(1),
(2) Date: Feb. 23, 2018

(87) PCT Pub. No.: WO2017/036958
PCT Pub. Date: Mar. 9, 2017

(65) Prior Publication Data

US 2018/0249760 A1 Sep. 6, 2018

Related U.S. Application Data

(63) Continuation of application No. 14/840,897, filed on Aug. 31, 2015, now abandoned.

(51) Int. Cl.
*A24F 40/42* (2020.01)
*A24B 15/16* (2020.01)
(Continued)

(52) U.S. Cl.
CPC ..... *A24F 40/42* (2020.01); *A24B 15/12* (2013.01); *A24B 15/16* (2013.01); *A24F 40/465* (2020.01); *H05B 6/105* (2013.01); *A24F 40/20* (2020.01)

(58) Field of Classification Search
CPC ..... A24F 47/004; A24F 47/008; A24F 40/42; A24F 40/465; A24F 40/20; A24B 15/16; A24B 15/12; H05B 6/105
(Continued)

(56) References Cited

U.S. PATENT DOCUMENTS 2,592,554 A 4/1952 Frankenburg
2,860,638 A 11/1958 Frank et al.
(Continued)

FOREIGN PATENT DOCUMENTS

AU 2014369867 A1 6/2016
AU 2017289114 B2 4/2020
(Continued)

OTHER PUBLICATIONS

Application and File History for U.S. Appl. No. 14/927,551, filed Oct. 30, 2015, inventors Blandino et al.
(Continued)

*Primary Examiner* — Tuan N Nguyen
(74) *Attorney, Agent, or Firm* — Patterson Thuente, P.A.

(57) ABSTRACT

Disclosed is a cartridge for use with apparatus for heating smokable material to volatilize at least one component of the smokable material, the cartridge including: a container defining a cavity, and smokable material located in the cavity, wherein the cartridge includes heating material that is heatable by penetration with a varying magnetic field to heat the smokable material. Also disclosed is apparatus for heating smokable material to volatilize at least one component of the smokable material, the apparatus including: an
(Continued)

interface for cooperating with an article comprising smokable material, a magnetic field generator for generating a varying magnetic field for penetrating the article when the interface is cooperating with the article, and a device for puncturing the article.

16 Claims, 2 Drawing Sheets

(51) Int. Cl.
*H05B 6/10* (2006.01)
*A24F 40/465* (2020.01)
*A24B 15/12* (2006.01)
*A24F 40/20* (2020.01)

(58) Field of Classification Search
USPC ..... 219/634
See application file for complete search history.

(56) References Cited

U.S. PATENT DOCUMENTS 3,065,756 A 11/1962 Noel et al.
3,144,174 A 8/1964 Henry et al.
3,173,612 A 3/1965 Gut et al.
3,517,151 A 6/1970 Mekjean et al.
3,596,034 A 7/1971 Mekjean
4,149,548 A 4/1979 Bradshaw
4,913,168 A 4/1990 Potter et al.
4,944,317 A 7/1990 Thal
5,093,894 A 3/1992 Deevi et al.
5,144,962 A 9/1992 Counts et al.
5,317,132 A 5/1994 Clough et al.
5,369,249 A 11/1994 Kwon
5,613,505 A 3/1997 Campbell et al.
5,649,554 A 7/1997 Sprinkel et al.
6,053,176 A 4/2000 Adams et al.
6,632,407 B1 10/2003 Lau et al.
6,803,550 B2 10/2004 Sharpe et al.
7,185,659 B2 3/2007 Sharpe
7,185,959 B2 3/2007 Mueller et al.
7,810,505 B2 10/2010 Yang
8,459,271 B2 6/2013 Inagaki
8,807,140 B1 8/2014 Scatterday
8,910,640 B2 12/2014 Sears et al.
9,357,803 B2 6/2016 Egoyants et al.
9,554,598 B2 1/2017 Egoyants et al.
9,980,512 B2 5/2018 Collett et al.
10,420,372 B2 9/2019 Suzuki et al.
10,524,508 B2 1/2020 Sur et al.
2002/0005207 A1 1/2002 Wrenn et al.
2002/0078951 A1 6/2002 Nichols et al.
2002/0078956 A1 6/2002 Sharpe et al.
2003/0007887 A1 1/2003 Roumpos et al.
2003/0102304 A1 6/2003 Boyers
2003/0230567 A1 12/2003 Centanni et al.
2004/0149297 A1 8/2004 Sharpe
2005/0025213 A1 2/2005 Parks
2005/0045193 A1 3/2005 Yang
2007/0267409 A1 11/2007 Gard et al.
2009/0120928 A1 5/2009 Lee et al.
2009/0151717 A1 6/2009 Bowen et al.
2009/0293888 A1 12/2009 Williams et al.
2010/0024834 A1 2/2010 Oglesby et al.
2010/0181387 A1 7/2010 Zaffaroni et al.
2011/0240022 A1 10/2011 Hodges et al.
2011/0271971 A1 11/2011 Conner et al.
2012/0145703 A1 6/2012 Matsen et al.
2012/0214926 A1 8/2012 Berthold et al.
2012/0234315 A1 9/2012 Li et al.
2012/0305545 A1 12/2012 Brosnan et al.
2013/0030125 A1 1/2013 Buryak et al.
2013/0133675 A1 5/2013 Shinozaki et al.
2013/0160780 A1 6/2013 Matsumoto et al.
2014/0060554 A1 3/2014 Collett et al.
2014/0158144 A1 6/2014 Kaljura et al.
2014/0216485 A1 8/2014 Egoyants et al.
2014/0301721 A1 10/2014 Ruscio et al.
2015/0040925 A1 2/2015 Saleem et al.
2015/0181937 A1 7/2015 Dubief et al.
2015/0201670 A1 7/2015 Crooks et al.
2015/0201675 A1 7/2015 Lord
2015/0237913 A1 8/2015 Suzuki et al.
2015/0245669 A1 9/2015 Cadieux et al.
2015/0272219 A1 10/2015 Hatrick et al.
2015/0335062 A1 11/2015 Shinkawa et al.
2016/0007652 A1 1/2016 Taluskie et al.
2016/0120221 A1 5/2016 Mironov et al.
2016/0150825 A1 6/2016 Mironov et al.
2016/0192708 A1* 7/2016 DeMeritt ..... A24F 47/008 131/329
2016/0324215 A1* 11/2016 Mironov ..... A24B 15/16
2016/0331031 A1 11/2016 Malgat et al.
2017/0055574 A1 3/2017 Kaufman et al.
2017/0055575 A1 3/2017 Wilke et al.
2017/0055580 A1 3/2017 Blandino et al.
2017/0055581 A1 3/2017 Wilke et al.
2017/0055582 A1 3/2017 Blandino et al.
2017/0055583 A1 3/2017 Blandino et al.
2017/0055584 A1 3/2017 Blandino et al.
2017/0055585 A1 3/2017 Fursa et al.
2017/0071250 A1 3/2017 Mironov et al.
2017/0095006 A1 4/2017 Egoyants et al.
2017/0119046 A1 5/2017 Kaufman et al.
2017/0119047 A1 5/2017 Blandino et al.
2017/0119048 A1 5/2017 Kaufman et al.
2017/0119049 A1 5/2017 Blandino et al.
2017/0119050 A1 5/2017 Blandino et al.
2017/0119051 A1 5/2017 Blandino et al.
2017/0156403 A1 6/2017 Gill et al.
2017/0174418 A1 6/2017 Cai
2017/0199048 A1 7/2017 Igumnov et al.
2017/0251718 A1 9/2017 Armoush et al.
2017/0325506 A1 11/2017 Batista
2018/0228217 A1 8/2018 Mironov et al.
2018/0235279 A1 8/2018 Wilke et al.
2018/0242633 A1 8/2018 Wilke et al.
2018/0242636 A1 8/2018 Blandino et al.
2018/0279677 A1 10/2018 Blandino et al.
2018/0317552 A1 11/2018 Kaufman et al.
2018/0317553 A1 11/2018 Blandino et al.
2018/0360123 A1 12/2018 Silvestrini
2019/0159517 A1 5/2019 Ballesteros Gomez et al.
2019/0191780 A1 6/2019 Wilke
2019/0230988 A1 8/2019 Aoun
2019/0239555 A1 8/2019 Nicholson
2020/0054068 A1 2/2020 Blandino
2020/0054069 A1 2/2020 Blandino
2020/0229497 A1 7/2020 Aoun
2020/0268053 A1 8/2020 Thorsen
2020/0288774 A1 9/2020 Blandino
2021/0100281 A1 4/2021 Abi Aoun
2022/0015408 A1 1/2022 Blandino

FOREIGN PATENT DOCUMENTS

CA 2003521 A1 5/1990
CA 2003522 A1 5/1990
CA 2937722 A1 11/2015
CA 2974770 A1 12/2015
CA 2982164 A1 10/2016
CN 1126426 A 7/1996
CN 2393205 Y 8/2000
CN 2738167 Y 11/2005
CN 2924411 Y 7/2007
CN 101084801 A 12/2007
CN 201076006 Y 6/2008
CN 201088138 Y 7/2008
CN 101227623 10/2008
CN 101326138 A 12/2008
CN 101390659 A 3/2009
CN 201199922 Y 3/2009
CN 101951796 1/2011

(56) References Cited

FOREIGN PATENT DOCUMENTS

| | | | |
|---|---|---|---|
| CN | 201762288 | U | 3/2011 |
| CN | 103202540 | A | 7/2013 |
| CN | 203369386 | U | 1/2014 |
| CN | 203435685 | U | 2/2014 |
| CN | 103689812 | A | 4/2014 |
| CN | 203735483 | U | 7/2014 |
| CN | 103988576 | A | 8/2014 |
| CN | 203748687 | U | 8/2014 |
| CN | 203762288 | U | 8/2014 |
| CN | 104013109 | A | 9/2014 |
| CN | 104095291 | A | 10/2014 |
| CN | 104256899 | A | 1/2015 |
| CN | 204091003 | U | 1/2015 |
| CN | 104365175 | A | 2/2015 |
| CN | 104470387 | A | 3/2015 |
| CN | 104480800 | A | 4/2015 |
| CN | 104619202 | A | 5/2015 |
| CN | 104664608 | A | 6/2015 |
| CN | 104768407 | A | 7/2015 |
| CN | 204519366 | U | 8/2015 |
| CN | 204539505 | U | 8/2015 |
| CN | 204599333 | U | 9/2015 |
| CN | 104994757 | A | 10/2015 |
| CN | 105188425 | A | 12/2015 |
| CN | 105682488 | A | 6/2016 |
| CN | 104095291 | B | 1/2017 |
| EA | 009116 | B1 | 10/2007 |
| EP | 0430559 | A2 | 6/1991 |
| EP | 0430566 | A2 | 6/1991 |
| EP | 0488488 | A1 | 6/1992 |
| EP | 0703735 | A1 | 4/1996 |
| EP | 0703735 | B1 | 7/2001 |
| EP | 1357025 | A2 | 10/2003 |
| EP | 1454840 | A1 | 9/2004 |
| EP | 1454840 | B1 | 9/2006 |
| EP | 1940254 | A2 | 7/2008 |
| EP | 2059091 | A2 | 5/2009 |
| EP | 1357025 | B1 | 7/2009 |
| EP | 2186833 | A1 | 5/2010 |
| EP | 2316286 | A1 | 5/2011 |
| EP | 2327318 | A1 | 6/2011 |
| EP | 2444112 | A1 | 4/2012 |
| EP | 2253541 | B1 | 5/2012 |
| EP | 2460424 | A1 | 6/2012 |
| EP | 2907397 | A1 | 8/2015 |
| EP | 3367823 | A2 | 9/2018 |
| EP | 3632244 | A1 | 4/2020 |
| GB | 347650 | A | 4/1931 |
| GB | 2495923 | A | 5/2013 |
| GB | 2504732 | A | 2/2014 |
| GB | 2504733 | A | 2/2014 |
| JP | S457120 | Y1 | 4/1970 |
| JP | H03113366 | A | 5/1991 |
| JP | H0556298 | U | 7/1993 |
| JP | H07502188 | A | 3/1995 |
| JP | H0850422 | A | 2/1996 |
| JP | H0851175 | A | 2/1996 |
| JP | H08511175 | A | 11/1996 |
| JP | 2002144451 | A | 5/2002 |
| JP | 2004121594 | A | 4/2004 |
| JP | 3588469 | B2 | 11/2004 |
| JP | 2004331191 | A | 11/2004 |
| JP | 2008050422 | A | 3/2008 |
| JP | 2008511175 | A | 4/2008 |
| JP | 2009087703 | A | 4/2009 |
| JP | 2010022754 | A | 2/2010 |
| JP | 2010050834 | A | 3/2010 |
| JP | 2010508034 | A | 3/2010 |
| JP | WO2010113702 | A1 | 10/2012 |
| JP | 2013013441 | A | 1/2013 |
| JP | 2013515465 | A | 5/2013 |
| JP | 2015524261 | A | 8/2015 |
| JP | 2015531601 | A | 11/2015 |
| JP | 2016508744 | A | 3/2016 |
| JP | 2016516402 | A | 6/2016 |
| JP | 2016538842 | A | 12/2016 |
| JP | 2017515490 | A | 6/2017 |
| JP | 6875044 | B2 | 5/2021 |
| JP | 6933323 | B2 | 9/2021 |
| KR | 100385395 | B1 | 8/2003 |
| KR | 100449444 | B1 | 8/2005 |
| KR | 20100108565 | A | 10/2010 |
| KR | 20130029697 | A | 3/2013 |
| KR | 20150027069 | A | 3/2015 |
| KR | 20150047616 | A | 5/2015 |
| KR | 20150132112 | A | 11/2015 |
| KR | 20150143877 | A | 12/2015 |
| KR | 20160064159 | A | 6/2016 |
| KR | 20170008209 | A | 1/2017 |
| RU | 2132629 | C1 | 7/1999 |
| RU | 2135054 | C1 | 8/1999 |
| RU | 103281 | U1 | 4/2011 |
| RU | 2425608 | C2 | 8/2011 |
| RU | 2509516 | C2 | 3/2014 |
| RU | 2531890 | C2 | 10/2014 |
| UA | 125609 | C2 | 5/2022 |
| WO | WO-8404698 | A1 | 12/1984 |
| WO | WO-9409842 | A1 | 5/1994 |
| WO | WO-9527411 | A1 | 10/1995 |
| WO | WO-9527412 | A1 | 10/1995 |
| WO | WO-9618662 | A1 | 6/1996 |
| WO | WO-02089532 | A1 | 11/2002 |
| WO | WO-02098389 | A1 | 12/2002 |
| WO | WO-2007051163 | A2 | 5/2007 |
| WO | WO-2008015441 | A1 | 2/2008 |
| WO | WO-2009079641 | A2 | 6/2009 |
| WO | WO-2010133342 | A1 | 11/2010 |
| WO | WO-2011130414 | A1 | 10/2011 |
| WO | WO-2012134117 | A2 | 10/2012 |
| WO | WO-2012164009 | A2 | 12/2012 |
| WO | WO-2013034459 | A1 | 3/2013 |
| WO | WO-2013098395 | A1 | 7/2013 |
| WO | WO-2013098409 | A1 | 7/2013 |
| WO | WO-2013131763 | A1 | 9/2013 |
| WO | WO-2013131764 | A1 | 9/2013 |
| WO | WO-2013144324 | A1 | 10/2013 |
| WO | WO-2013178766 | A1 | 12/2013 |
| WO | WO-2014023965 | A1 | 2/2014 |
| WO | WO-2014023967 | A1 | 2/2014 |
| WO | WO-2014048745 | A1 | 4/2014 |
| WO | WO-2014054035 | A1 | 4/2014 |
| WO | WO-2014061477 | A1 | 4/2014 |
| WO | WO-2014102092 | A1 | 7/2014 |
| WO | WO-2014104078 | A1 | 7/2014 |
| WO | WO-2014139611 | A1 | 9/2014 |
| WO | WO-2014140320 | A1 | 9/2014 |
| WO | WO-2015019101 | A1 | 2/2015 |
| WO | WO-2015062983 | A2 | 5/2015 |
| WO | WO-2015071682 | A1 | 5/2015 |
| WO | WO-2015082648 | A1 | 6/2015 |
| WO | WO-2015082649 | A1 | 6/2015 |
| WO | WO-2015082651 | A1 | 6/2015 |
| WO | WO-2015082652 | A1 | 6/2015 |
| WO | WO-2015082653 | A1 | 6/2015 |
| WO | WO-2015100361 | A1 | 7/2015 |
| WO | WO-2015101479 | A1 | 7/2015 |
| WO | WO-2015116934 | A1 | 8/2015 |
| WO | WO-2015117702 | A1 | 8/2015 |
| WO | WO-2015131058 | A1 | 9/2015 |
| WO | WO-2015155289 | A1 | 10/2015 |
| WO | WO-2015166245 | A2 | 11/2015 |
| WO | WO-2015175568 | A1 | 11/2015 |
| WO | WO-2015176898 | A1 | 11/2015 |
| WO | WO-2015177043 | A1 | 11/2015 |
| WO | WO-2015177044 | A1 | 11/2015 |
| WO | WO-2015177045 | A1 | 11/2015 |
| WO | WO-2015177046 | A1 | 11/2015 |
| WO | WO-2015177247 | A1 | 11/2015 |
| WO | WO-2015177253 | A1 | 11/2015 |
| WO | WO-2015177255 | A1 | 11/2015 |
| WO | WO-2015177257 | A1 | 11/2015 |
| WO | WO-2015177264 | A1 | 11/2015 |
| WO | WO-2015177294 | A1 | 11/2015 |
| WO | WO-2015198015 | A1 | 12/2015 |

(56) References Cited

FOREIGN PATENT DOCUMENTS

| | | | |
|---|---|---|---|
| WO | WO-2016023965 | A1 | 2/2016 |
| WO | WO-2016075426 | A1 | 5/2016 |
| WO | WO-2016075436 | A1 | 5/2016 |
| WO | WO-2016096865 | A2 | 6/2016 |
| WO | WO-2016162446 | A1 | 10/2016 |
| WO | WO-2016207407 | A1 | 12/2016 |
| WO | WO-2017005705 | A1 | 1/2017 |
| WO | WO-2017029269 | A1 | 2/2017 |
| WO | WO-2017036950 | A2 | 3/2017 |
| WO | WO-2017036951 | A1 | 3/2017 |
| WO | WO-2017036954 | A1 | 3/2017 |
| WO | WO-2017036955 | A2 | 3/2017 |
| WO | WO-2017036957 | A1 | 3/2017 |
| WO | WO-2017036958 | A2 | 3/2017 |
| WO | WO-2017036959 | A1 | 3/2017 |
| WO | WO-2017036958 | A3 | 4/2017 |
| WO | WO-2017068098 | A1 | 4/2017 |
| WO | WO-2017072145 | A1 | 5/2017 |
| WO | WO-2017072146 | A1 | 5/2017 |
| WO | WO-2017072147 | A2 | 5/2017 |
| WO | WO-2017072148 | A1 | 5/2017 |
| WO | WO-2017072147 | A3 | 7/2017 |
| WO | WO-2017167932 | A1 | 10/2017 |

OTHER PUBLICATIONS

Application and File History for U.S. Appl. No. 14/927,556, filed Oct. 30, 2015, inventors Blandino et al.
Application and File History for U.S. Appl. No. 15/772,391, filed Apr. 30, 2018, inventor Duane A Kaufman.
Application and File History for U.S. Appl. No. 15/772,396, filed Apr. 30, 2018, inventor Thomas P. Blandino.
Application and File History for U.S. Appl. No. 15/772,399, filed Apr. 30, 2018, inventor Thomas P. Blandino.
Application and File History for U.S. Appl. No. 15/772,394, filed Apr. 30, 2018, inventors Blandino et al.
Application and File History for U.S. Appl. No. 14/927,537, filed Oct. 30, 2015, inventors Kaufman et al.
Application and File History for U.S. Appl. No. 14/927,539, filed Oct. 30, 2015, inventors Blandino et al.
Examination Report for Australian Application No. 2016313708, dated Nov. 1, 2019, 7 pages.
Examination Report for Australian Application No. 2016313708, dated Nov. 23, 2018, 6 pages.
First Office Action and Search Report dated Mar. 4, 2020 for Chinese Application No. 201680077608.1 filed Oct. 26, 2016, 18 pages.
International Preliminary Report on Patentability for Application No. PCT/EP2016/075735, dated Jan. 2, 2018, 8 pages.
International Preliminary Report on Patentability for Application No. PCT/EP2016/075737, dated May 11, 2018, 10 pages.
International Preliminary Report on Patentability for Application No. PCT/EP2016/075738, dated May 11, 2018, 9 pages.
International Preliminary Report on Patentability for Application No. PCT/EP2016/070190, dated Mar. 15, 2018, 12 pages.
International Preliminary Report on Patentability for Application No. PCT/EP2016/075736, dated May 11, 2018, 6 pages.
International Search Report and Written Opinion for Application No. PCT/EP2016/070190, dated Mar. 13, 2017, 19 pages.
International Search Report and Written Opinion for Application No. PCT/EP2016/075735, dated Feb. 2, 2017, 10 pages.
International Search Report and Written Opinion for Application No. PCT/EP2016/075736, dated Feb. 14, 2017, 6 pages.
International Search Report and Written Opinion for Application No. PCT/EP2016/075737, dated Jun. 16, 2017, 14 pages.
International Search Report and Written Opinion for Application No. PCT/EP2016/075738, dated Mar. 2, 2017, 12 pages.
Iorga A., et al., "Low Curie Temperature in Fe—Cr—Ni—Mn Alloys," U.P.B. Sci.Bull., Series B, vol. 73 (4), 2011, pp. 195-202.
Neomax Materials Co., Ltd., "NeoMax MS-135," retrieved from http://www.neomax-materials.co.jp/eng/pr0510.htm, as accessed on Oct. 30, 2015, 2 pages.
Notice of Reasons For Rejection Office Action dated Mar. 17, 2019 for Japanese Application No. 2018-522061, 7 pages.
Office Action dated Jun. 25, 2019 for Japanese Application No. 2018-521546, 4 pages.
Office Action dated Dec. 11, 2019 for Brazilian Application No. BR1120180085138, 6 pages.
Office Action dated Mar. 22, 2019 for Korean Application No. 10-2018-7012422, 19 pages.
Office Action dated Mar. 22, 2019 for Korean Application No. 10-2018-7012428, 22 pages.
Office Action dated Jul. 23, 2019 for Japanese Application No. 2018-521928, 14 pages.
Office Action dated Jul. 23, 2019 for Japanese Application No. 2018-522061, 9 pages.
Office Action dated Jun. 25, 2019 for Japanese Application No. 2018-519932, 5 pages.
Office Action dated Sep. 26, 2019 for Korean Application No. 10-2018-7012353, 15 pages.
Office Action dated Dec. 27, 2019 for Chinese Application No. 201680049091, 25 pages.
Office Action dated Mar. 28, 2019 for Canadian Application No. 3003520, , 3 pages.
Office Action dated Mar. 29, 2019 for Korean Application No. 10-2018-7012366, 6 pages.
Office Action dated Oct. 29, 2018 for Russian Application No. 20185542, 9 pages.
Office Action dated Feb. 4, 2020 for Japanese Application No. 2018-507621, 29 pages.
Office Action dated Feb. 7, 2019 for Korean Application No. 10-2018-7006076, 10 pages.
Office Action dated May 7, 2019 for Japanese Application No. 2018-507621, 8 pages.
Office Action dated Dec. 9, 2019 for Canadian Application No. 3003521, 6 pages.
Todaka T., et al., "Low Curie Temperature Material for Induction Heating Self- Temperature Controlling System," Journal of Magnetism and Magnetic Materials, vol. 320 (20), Oct. 2008, pp. e702-e707.
English Translation of Chinese Office Action, Application No. 2016800490915, dated Aug. 14, 2020, 8 pages.
Communication pursuant to Article 94(3) EPC for Application No. 16798648.8, dated Nov. 19, 2020, 9 pages.
European Search Report for European Application No. 20205063.9, dated Feb. 18, 2021. 13 pages.
Examination Report dated Sep. 6, 2019 for Australian Application No. 2017289114, 7 pages.
Examination Report No. 1 for Australian Patent Application No. 2018334042 dated Dec. 16, 2020, 4 pages.
Extended European Search Report for Application No. 20205065.4, dated Mar. 10, 2021, 14 pages.
International Preliminary Report on Patentability for Application No. PCT/EP2017/065906, dated Jan. 10, 2019, 9 pages.
International Preliminary Report on Patentability for Application No. PCT/EP2017/065908, dated Jan. 10, 2019, 9 pages.
International Preliminary Report on Patentability for Application No. PCT/EP2018/075093, dated Mar. 26, 2020, 8 pages.
International Preliminary Report on Patentability for Application No. PCT/EP2017/065909, dated Jan. 10, 2019, 7 pages.
International Search Report and Written Opinion for Application No. PCT/EP2017/065906, dated Oct. 24, 2017, 16 pages.
International Search Report and Written Opinion for Application No. PCT/EP2017/065908, dated Oct. 17, 2017, 11 pages.
International Search Report and Written Opinion for Application No. PCT/EP2017/065909, dated Oct. 24, 2017, 10 pages.
International Search Report and Written Opinion for Application No. PCT/EP2018/058195, dated Nov. 12, 2018, 20 pages.
International Search Report and Written Opinion for Application No. PCT/EP2018/075093, dated Jan. 4, 2019, 11 pages.
Notice of Reasons For Refusal Office Action dated Sep. 8, 2020 for Japanese Application No. 2018-567856, 8 pages.

(56) References Cited

OTHER PUBLICATIONS

Office Action and Search Report dated Apr. 14, 2020 for Chinese Application No. 201680063711.0, 28 pages.
Office Action For Canadian Application No. 3,056,677, dated Nov. 24, 2020, 6 pages.
Office Action For Chinese Application No. 201680072882.X, dated Jan. 14, 2021, 12 pages.
Office Action for Chinese Application No. 201780039879.2 dated Sep. 18, 2020, 7 pages.
Office Action dated Mar. 1, 2019 for Canadian Application No. 2996341, 4 pages.
Office Action dated Sep. 9, 2020 for Chinese Application No. 201780040874.1, 20 pages.
Office Action dated Sep. 15, 2020 for Japanese Application No. 2018-567854, 8 pages.
Office Action dated Aug. 19, 2020 for KR Application No. 20187037693, filed Jun. 27, 2017, 21 pages.
Office Action dated Feb. 25, 2020 for Japanese Application No. 2018-567854, 7 pages.
Office Action dated Feb. 25, 2020 for Japanese Application No. 2018-567947, 6 pages.
Office Action dated Feb. 25, 2020 for Japanese Appliication No. 2018-567856, 6 pages.
Notice of Opposition mailed Jun. 3, 2020 for European Application No. 16766494.5, 37 pages.
Communication pursuant to Article 94(3) EPC for Application No. 16798649.6, dated Jul. 5, 2021, 7 pages.
Extended European Search Report for Application No. 20202666.2, dated Feb. 19, 2021, 14 pages.
Extended European Search Report for Application No. 20204770.0, dated Jun. 30, 2021, 14 pages.
Extended European Search Report for Application No. 20205060.5, dated Mar. 2, 2021, 19 pages.
Extended European Search Report for Application No. 20205060.5, dated Aug. 6, 2021, 20 pages.
Extended European Search Report for Application No. EP20205306.2, dated Feb. 19, 2021, 12 pages.
International Search Report for Application No. PCT/EP2018/083795, dated Mar. 15, 2019, 3 pages.
Notice of Reasons for Refusal For Japanese Application No. 2020-528003, dated Jul. 20, 2021, 3 pages.
Office Action dated Jun. 1, 2021, for Russian Application No. 2020135859, 12 pages.
Office Action dated Jun. 17, 2021 for Ukraine Application No. 201804590, 3 pages.
Office Action For Canadian Application No. 3,003,519, dated Jul. 30, 2021, 4 pages.
Office Action For Chinese Application No. 201680072882. X, dated Sep. 1, 2021, 17 pages.
Office Action For Japanese Application No. 2020-093539, dated Apr. 6, 2021, 6 pages.
Office Action For Japanese Application No. 2020-175420, dated Oct. 12, 2021, 9 pages.
Office Action For Japanese Application No. 2020-182740, dated Oct. 12, 2021, 10 pages.
Office Action For Japanese Application No. 2020-182750, dated Oct. 12, 2021, 8 pages.
Office Action For Japanese Application No. 2020-183062, dated Nov. 30, 2021, 6 pages.
Office Action For Japanese Application No. 2020-191836, dated Oct. 26, 2021, 8 pages.
Office Action For Japanese Application No. 2020-191838, dated Oct. 26, 2021, 8 pages.
Office Action For Korean Application No. 10-2018-7037677, dated May 12, 2021, 4 pages.
Office Action For Korean Application No. 10-2018-7037677, dated Mar. 29, 2021, 6 pages.
Office Action For Korean Application No. 10-2021-7018056, dated Oct. 27, 2021, 21 pages.
Office Action for Malaysian Application No. PI2018002742, dated Apr. 21, 2021, 4 pages.
Office Action For Russian Application No. 2020135808, dated Apr. 23, 2021, 12 pages.
Office Action For Russian Application No. 2020135851, dated May 24, 2021, 13 pages.
Office Action dated May 12, 2021 for Chinese Application No. 201780040874.1, 15 pages.
Office Action dated May 12, 2021 for Korean Application No. 10-2018-7037693, 7 pages.
Office Action dated Feb. 16, 2021 for Japanese Application No. 2018-567856, 2 pages.
Office Action dated Mar. 2, 2021 for Japanese Application No. 2018-567947, 4 pages.
Office Action dated Apr. 29, 2021, for Malaysian Application No. PI2018701525, 3 pages.
Communication pursuant to Article 94(3) EPC for Application No. 17740628.7 dated May 9, 2022, 9 pages.
Communication pursuant to Article 94(3) EPC for Application No. 21213373.0 dated May 9, 2022, 6 pages.
Decision to Grant a Patent dated Mar. 15, 2022 for Japanese Application No. 2020-183062, 5 pages.
European Search Report for Application No. 21213373.0, dated Apr. 26, 2022, 7 pages.
Notification of Reason for Refusal dated Jan. 3, 2022 for Korean Application No. 10-2020-7018918, 12 pages.
Office Action and Search Report for Chinese Application No. 201880059756, dated Jan. 14, 2022, 11 pages.
Office Action and Search Report for Russian Application No. 2020134245, dated Jan. 19, 2022, 27 pages.
Office Action and Search Report dated Jan. 18, 2022 for Russian Application No. 2020134241, 22 pages.
Office Action for Brazilian Application No. 112018077348-4, dated Sep. 27, 2021, 4 pages.
Office Action For Chinese Application No. 201780040300.4, dated Nov. 15, 2021, 14 pages.
Office Action for Japanese Application No. 2022-010005, dated Mar. 15, 2022, 3 pages.
Office Action For Korean Application No. 10-2021-7023346, dated Dec. 14, 2021, 40 pages.
Office Action for Ukraine Application No. a201813017, dated May 6, 2022, 3 pages.
Office Action for Korean Application No. 10-2020-7011369, dated May 10, 2022, 18 pages.
Office Action dated Jun. 22, 2022 for Russian Application No. 2019107295, 8 pages.
Office Action for Chinese Application No. 201780040300.4, dated Apr. 26, 2022, 9 pages.
Office Action For Japanese Application No. 2020-191838, dated Jul. 5, 2022, 6 pages.
Office action for Korean Application No. 10-2020-7018918, dated Jul. 27, 2022, 6 pages.

* cited by examiner

CARTRIDGE FOR USE WITH APPARATUS FOR HEATING SMOKABLE MATERIAL

PRIORITY CLAIM

The present application is a National Phase entry of PCT Application No. PCT/EP2016/070190, filed Aug. 26, 2016, which claims priority from U.S. patent application Ser. No. 14/840,897, filed Aug. 31, 2015, each of which is hereby fully incorporated herein by reference.

TECHNICAL FIELD

The present disclosure relates to apparatus for heating smokable material to volatilize at least one component of the smokable material, to cartridges for use with such apparatus, and to systems comprising such cartridges and such apparatus.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides a cartridge for use with apparatus for heating smokable material to volatilize at least one component of the smokable material, the cartridge comprising: a container defining a cavity; and smokable material located in the cavity; wherein the cartridge comprises heater or heating material that is heatable by penetration with a varying magnetic field to heat the smokable material.

In an exemplary embodiment, the container comprises the heating material.

In an exemplary embodiment, the heating material comprises one or more materials selected from the group consisting of: an electrically-conductive material, a magnetic material, and a non-magnetic material.

In an exemplary embodiment, the heating material comprises a metal or a metal alloy.

In an exemplary embodiment, the heating material comprises one or more materials selected from the group consisting of: aluminum, gold, iron, nickel, cobalt, conductive carbon, graphite, plain-carbon steel, stainless steel, ferritic stainless steel, copper, and bronze.

In an exemplary embodiment, the container defines an opening into the cavity and the cartridge comprises a seal sealing the opening.

In an exemplary embodiment, the seal is a film seal.

In an exemplary embodiment, the seal comprises a foil of electrically-conductive material.

In an exemplary embodiment, the seal is permanently affixed to the container.

In an exemplary embodiment, the seal is welded to the container.

In an exemplary embodiment, the seal is adhered to the container.

In an exemplary embodiment, the seal is clamped to the container.

In an exemplary embodiment, the cartridge is for at least partial insertion into a recess of the apparatus, and the container comprises an external flange extending at least partially around the cavity for positioning the cartridge relative to the recess.

In an exemplary embodiment, an exterior dimension of the container reduces with distance from the opening.

In an exemplary embodiment, the container has an air flow inlet extending therethrough for admitting air into the cavity from an exterior of the container.

In an exemplary embodiment, the container is made of porous material for admitting air into the cavity from an exterior of the container.

In an exemplary embodiment, the smokable material comprises tobacco and/or one or more humectants.

In an exemplary embodiment, the cartridge comprises a temperature detector for detecting a temperature of the cartridge. In some embodiments, the cartridge comprises one or more terminals connected to the temperature detector for making connection with a temperature monitor of the apparatus in use.

A second aspect of the present disclosure provides a cartridge for use with apparatus for heating smokable material to volatilize at least one component of the smokable material, the cartridge comprising: a container defining a cavity; smokable material located in the cavity; and heating material in the cavity, wherein the heating material is heatable by penetration with a varying magnetic field to heat the smokable material.

In respective exemplary embodiments, the cartridge may have any of the features of the above-described exemplary embodiments of the cartridge of the first aspect of the present disclosure.

In an exemplary embodiment, the container comprises a body located between the container and the smokable material, wherein the body comprises the heating material.

In an exemplary embodiment, the container comprises a vessel defining the cavity, and wherein the vessel is made of non-electrically-conductive material.

In an exemplary embodiment, the container comprises a vessel defining the cavity, and a liner on at least a portion of an interior surface of the vessel, wherein the liner comprises the heating material.

In an exemplary embodiment, the liner is for permitting air to pass through the liner.

In an exemplary embodiment, the cartridge comprises a body located within the smokable material, wherein the body comprises the heating material.

A third aspect of the present disclosure provides a cartridge for use with apparatus for heating smokable material to volatilize at least one component of the smokable material, the cartridge comprising: a container defining a cavity and an opening into the cavity; smokable material located in the cavity; and a seal permanently affixed to the container and sealing the opening.

In respective exemplary embodiments, the cartridge may have any of the features of the above-described exemplary embodiments of the cartridge of the first or second aspect of the present disclosure.

A fourth aspect of the present disclosure provides a cartridge for insertion into a recess of apparatus for heating smokable material to volatilize at least one component of the smokable material, the cartridge comprising: a container defining a cavity and an opening into the cavity; smokable material located in the cavity; and a seal sealing the opening;

wherein the container comprises an external flange extending at least partially around the opening or cavity for positioning the cartridge relative to the recess.

In respective exemplary embodiments, the cartridge may have any of the features of the above-described exemplary embodiments of the cartridge of the first, second or third aspect of the present disclosure.

A fifth aspect of the present disclosure provides apparatus for heating smokable material to volatilize at least one component of the smokable material, the apparatus comprising: an interface for cooperating with an article comprising smokable material; a magnetic field generator for generating a varying magnetic field for penetrating the article when the interface is cooperating with the article; and a device for puncturing the article.

In an exemplary embodiment, the apparatus comprises a body and a mouthpiece that is movable relative to the body, wherein the body comprises the interface, and wherein the mouthpiece comprises the device.

In an exemplary embodiment, the device is for puncturing the article as the mouthpiece is moved relative to the body when the article is cooperating with the interface.

In an exemplary embodiment, the device forms at least part of a passageway for permitting volatilized material to pass from the cavity of the container to an exterior of the apparatus in use.

In an exemplary embodiment, the interface comprises a recess for receiving at least a portion of the article.

A sixth aspect of the present disclosure provides a system, comprising: a thermally-conductive cartridge comprising a container defining a cavity, and smokable material located in the cavity; and apparatus for heating smokable material to volatilize at least one component of the smokable material, the apparatus having an interface for cooperating with the cartridge, a magnetic field generator for generating a varying magnetic field, and a heating element comprising heating material that is heatable by penetration with the varying magnetic field to heat the cartridge when the interface is cooperating with the cartridge.

In respective exemplary embodiments, the cartridge of the system may have any of the features of the above-described exemplary embodiments of the article of the first, second, third or fourth aspect of the present disclosure.

A seventh aspect of the present disclosure provides apparatus for heating smokable material to volatilize at least one component of the smokable material, the apparatus comprising: an interface for cooperating with an article comprising smokable material; a magnetic field generator for generating a varying magnetic field, and a heating element comprising heating material that is heatable by penetration with the varying magnetic field to heat the article when the interface is cooperating with the article.

BRIEF DESCRIPTION OF THE DRAWINGS

Embodiments of the disclosure will now be described, by way of example only, with reference to the accompanying drawings, in which.

DETAILED DESCRIPTION

Figure 1:
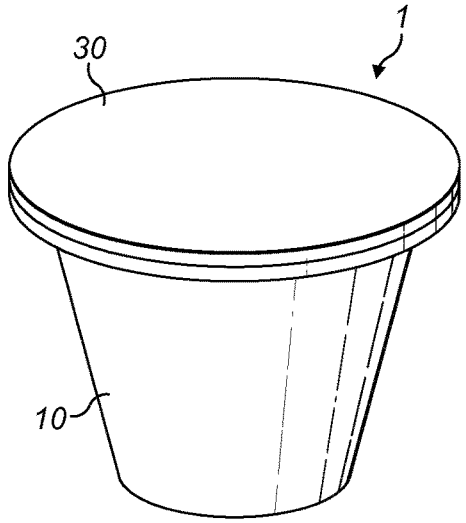
FIG. 1 shows a schematic perspective view of an example of a cartridge for use with apparatus for heating smokable material to volatilize at least one component of the smokable material.

As used herein, the term "smokable material" includes materials that provide volatilized components upon heating, typically in the form of vapor or an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, liquid, gel, gelled sheet, powder, or agglomerates. "Smokable material" also may include other, non-tobacco, products, which, depending on the product, may or may not contain nicotine. "Smokable material" may comprise one or more humectants, such as glycerol or propylene glycol.

As used herein, the term "heating material" refers to material that is heatable by penetration with a varying magnetic field.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, gel, powder, or the like.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, material deposits on the object such as smokable material residue may be less of an issue, design freedom and control over the heating profile may be greater, and cost may be lower.

Figure 2:
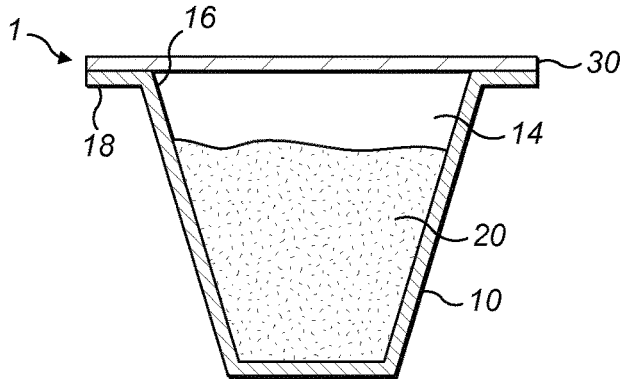
FIG. 2 shows a schematic cross-sectional view of the cartridge of FIG. 1.

Referring to FIGS. 1 and 2 there are shown a schematic perspective view and a schematic cross-sectional view of an example of an article in the form of a cartridge according to an embodiment of the disclosure. The cartridge 1 comprises a container 10 defining a cavity 14 and an opening 16 into the cavity 14, smokable material 20 located in the cavity 14, and a seal 30 sealing the opening 16. The cartridge 1 is for use with apparatus for heating the smokable material 20 to volatilize at least one component of the smokable material 20 without burning the smokable material 20, such as the apparatus 100 shown in FIG. 5 and described below.

In this embodiment, the container 10 takes the form of a vessel that is free of heating material. In this embodiment, the vessel is made of a non-electrically-conductive material. In this embodiment, the container 10 is made from a high-temperature-tolerant plastics material, such as polyether ether ketone (PEEK) or polyetherimide (PEI), an example of which is Ultem. However, in other embodiments, the container 10 may be made from a different material that is resistant to heat at least over the expected range of operating temperatures of the apparatus 100 that will arise in operation, such as for example 180 to 220 degrees Celsius. As discussed below, the apparatus 100 with which the cartridge 1 is usable comprises a heating element 115 that is heatable by penetration with a varying magnetic field to heat the smokable material 20 in the cavity 14 of the container 10. Accordingly, in this embodiment, the container 10 is made of thermally-conductive material for conducting heat from outside of the container 10 to the cavity 14 and the smokable material 20 therein. The cartridge 1 is thus a thermally-conductive cartridge 1.

In other embodiments, the container 10 may comprise heating material that is heatable by penetration with a varying magnetic field. For example, a portion, or plural discrete portions, or all of the container 10 may be made from such heating material. The heating material of the container 10 may be any one or more of the heating materials discussed herein.

In this embodiment, the container 10 has been made by thermoforming the material from which it is made. In the process of thermoforming, a sheet of material is heated to a pliable forming temperature, formed to a specific shape in a mould, and then cooled to a finished shape. The sheet of material may be trimmed, if required, before, during or after cooling. In other embodiments, the container 10 may have been made according to a different process, such as injection molding.

In this embodiment, the container 10 is impermeable to air. However, in some embodiments, the container 10 may have an air flow inlet extending therethrough for admitting air into the cavity 14 from an exterior of the container 10. For example, in some embodiments, the container 10 may be made of a material that is impermeable to air and have one or more apertures extending therethrough for admitting air into the cavity 14 from the exterior of the container 10. In other embodiments, the container 10 may be made of porous material for admitting air into the cavity 14 from the exterior of the container 10. Such a porous container 10 may or may not have one or more apertures extending therethrough.

In this embodiment, the cartridge 1 is for at least partial insertion into a recess 111 of the apparatus 100, and the container 10 comprises an external flange 18 extending fully around the cavity 14 for positioning the cartridge 1 relative to the recess 111. In other embodiments, the external flange 18 may extend only partially around the cavity 14, or a plurality of circumferentially-spaced external flanges 18 may be provided around the cavity 14. In some embodiments, the external flange(s) 18 may be omitted.

In this embodiment, an exterior dimension of the container 10 reduces with distance from the opening 16. This aids insertion and removal of the cartridge 1 from the recess 111 of the apparatus 100 in use. More particularly, in this embodiment, an exterior width or diameter of the container 10 tapers with distance from the opening 16. In this embodiment, the taper is linear or substantially linear, but in other embodiments the taper may be non-linear; for example, the outer surface of the container 10 may be concave or convex. In some embodiments, the exterior dimension of the container 10 may reduce in a manner other than by tapering, such as stepwise. In other embodiments, the external dimension of the container 10 may be constant, or substantially constant, over a full length of the container 10.

In this embodiment, the container 10 has a circular cross section. In some embodiments, the container 10 may be rotationally symmetrical and other than circular, such as elliptical, triangular or square. In other embodiments, the container 10 may be rotationally asymmetrical. In this embodiment, the cavity 14 is circular in cross section and the opening 16 is circular. In other embodiments, the cavity 14 and/or the opening 16 may be of a shape other than circular.

In some embodiments, the cavity 14 may hold up to 1 gram of the smokable material 20, such as up to 0.5 grams. As noted above, the cartridge 1 also comprises a seal 30 that seals the opening 16 of the container 10. Prior to puncturing or removal from the container 10, the seal 30 acts to prevent spilling of the smokable material 20 from the cavity 14, and also serves to preserve the smokable material 20.

In this embodiment, the seal 30 comprises a film seal. The film seal may, for example, by between 9 and 25 microns thick. The use of a film facilitates breaking the seal 30 in use by puncturing, as will be described below. However, in other embodiments, the seal 30 may be other than a film. In this embodiment, the seal 30 comprises a metal foil. The metal may be, for example, aluminum. The seal 30 may consist of the metal foil or may instead comprise a plurality of layers, of which one layer is the metal foil. In some embodiments, the seal 30 may comprise a laminate. The metal foil serves as a vapor barrier. In some embodiments, the seal 30 comprises heating material that is heatable by penetration with a varying magnetic field to heat the smokable material 20, in a similar manner to that described below. In other embodiments, the seal 30 may be free of heating material. For example, in some embodiments, the seal 30 may consist of a film of plastics material.

In this embodiment, the seal 30 is permanently affixed to the container 10 by adhesive. Any suitable adhesive may be used, such as a food-grade adhesive. In other embodiments, the seal 30 may be permanently affixed to the container 10 in some other way, such as by being clamped to the container 10 or welded, such as heat welded or sonically welded. By "permanently affixed" it is meant that the seal 30 is irremovable, or substantially irremovable, from the container 10 without the seal 30 tearing or being broken into plural parts. In other embodiments, the seal 30 may be peelable from the container 10 without the structure of the seal 30 being compromised. In some embodiments, the seal 30 may be removable from the container 10 and later re-attached to the container 10. In some such embodiments, the seal 30 may be adhered to the container 10 by an adhesive that allows the seal 30 to be detached and re-adhered to the container 10.

In this embodiment, the seal 30 is affixed to the flange 18 of the container 10. However, in other embodiments, including those in which the flange 18 is omitted, the seal 30 may be affixed elsewhere on the container 10 to seal the opening 16, such as on a rim of the container 10 that defines the opening 16.

In this embodiment, the container 10 of the cartridge 1 is free of heating material that is heatable by penetration with a varying magnetic field. However, in other embodiments, the container 10 may comprise heating material that is heatable by penetration with a varying magnetic field to heat the smokable material 20, in a similar manner to that described below.

Figure 3:
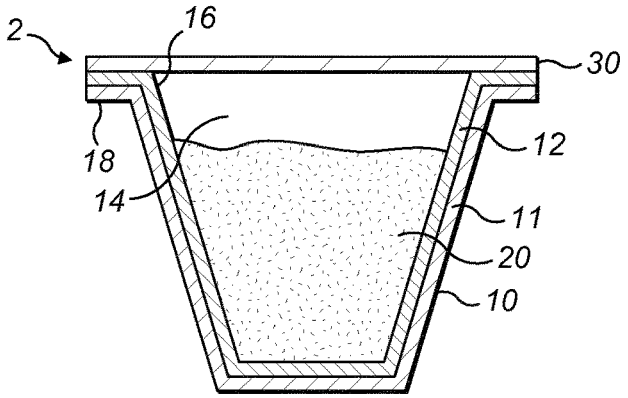
FIG. 3 shows a schematic cross-sectional view of an example of another cartridge for use with apparatus for heating smokable material to volatilize at least one component of the smokable material.

Referring to FIG. 3 there is shown a schematic cross-sectional view of an example of another article in the form of a cartridge according to an embodiment of the disclosure. As for the cartridge 1 of FIGS. 1 and 2, the cartridge 2 of FIG. 3 comprises a container 10 defining a cavity 14 and an opening 16 into the cavity 14, smokable material 20 located in the cavity 14, and a seal 30 sealing the opening 16. The cartridge 2 is for use with apparatus for heating the smokable material 20 to volatilize at least one component of the smokable material 20, such as a variation to the apparatus 100 shown in FIG. 5 and described below.

In this embodiment, the container 10 comprises a vessel 11 that defines the cavity 14. In the cavity are the smokable material 20 and heating material 12 that is heatable by penetration with a varying magnetic field to heat the smokable material 20. In this embodiment, the vessel 11 is made of non-electrically-conductive material, such as a plastics material or paper. In this embodiment, the heating material comprises a liner 12 that covers an interior surface of the vessel 11. Thus, in this embodiment, the liner 12 is located between the vessel 11 and the smokable material 20. In other embodiments, the liner 12 may be on only a portion, or only on some portions, of the interior surface of the vessel 11. In other embodiments, the heating material may be comprised in a body other than a liner, such as a body located within the smokable material 20, a body located between the smokable material 20 and the seal 30, or a body located between the container 10 and the smokable material, such as at the end of the cavity 14 furthest from the opening 16. Such a body may take the form of a mesh, for example.

In this embodiment, the heating material is aluminum. In other embodiments, the heating material may comprise one or more materials selected from the group consisting of: an electrically-conductive material, a magnetic material, and a non-magnetic material. In some embodiments, the heating material may comprise a metal or a metal alloy. In some embodiments, the heating material may comprise one or more materials selected from the group consisting of: aluminum, gold, iron, nickel, cobalt, conductive carbon, graphite, plain-carbon steel, stainless steel, ferritic stainless steel, copper, and bronze. Other heating material(s) may be used in other embodiments. In some embodiments, the heating material may be magnetic. It has also been found that, when magnetic electrically-conductive material is used as the heating material, magnetic coupling between the magnetic electrically-conductive material and an electromagnet of the apparatus in use may be enhanced. In addition to potentially enabling magnetic hysteresis heating, this can result in greater or improved Joule heating of the heating material, and thus greater or improved heating of the smokable material 20.

In this embodiment, the vessel 11 of the container 10 and the seal 30 take the same form as the container 10 and the seal 30, respectively, of the cartridge 1 of FIGS. 1 and 2, and so no further description thereof will be provided, in the interest of conciseness. However, it will be noted that, in this embodiment, the flange 18 of the container 10 comprises portions of both the vessel 11 and the liner 12, and the seal 30 is affixed to the liner 12. However, in other embodiments, the flange 18 may be free of the liner 12 and the seal 30 may be affixed to the vessel 11.

Figure 4:
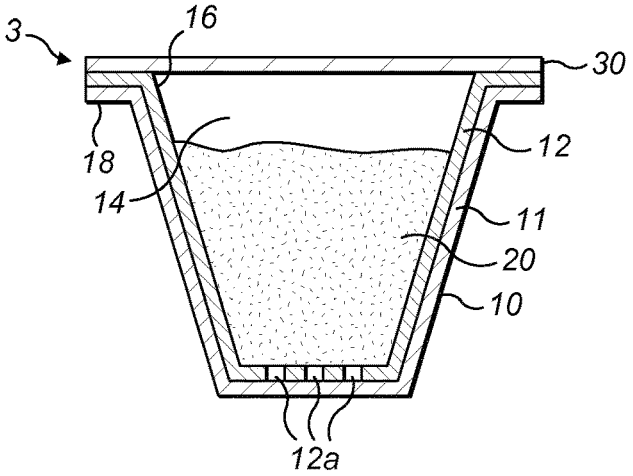
FIG. 4 shows a schematic cross-sectional view of an example of another cartridge for use with apparatus for heating smokable material to volatilize at least one component of the smokable material.

Referring to FIG. 4 there is shown a schematic cross-sectional view of an example of another article in the form of a cartridge according to an embodiment of the disclosure. The cartridge 3 of FIG. 4 is identical to the cartridge 2 described above with reference to FIG. 3, other than for the material from which the vessel 11 is made and the form of the liner 12. Any of the above-described possible variations to the cartridge 2 of FIG. 3 may be made to the cartridge 3 of FIG. 4 to form separate respective embodiments.

In this embodiment, the vessel 11 is made of porous material for admitting air into the cavity 14 from an exterior of the container 10. In this embodiment, the material is a porous paper, but in variations to this embodiment other porous material may be used. In some embodiments, such a porous vessel 11 may have one or more apertures extending therethrough for facilitating air flow through the vessel 11.

In this embodiment, the liner 12 is for permitting air to pass through the liner 12. More particularly, in this embodiment, the liner 12 is made of a material that is impermeable to air but has a plurality of apertures 12*a* extending therethrough for admitting air from the side of the liner 12 that faces or contacts the vessel 11 to the opposite side of the liner 12 that faces or contacts the smokable material 20. The liner 12 may be a mesh. In a variation to this embodiment, the liner 12 may have only one aperture 12*a* extending therethrough. In a further variation to this embodiment, the liner 12 may be made of porous material. Such a porous liner 12 may or may not have one or more apertures 12*a* extending therethrough. The liner 12 still may be made of electrically-conductive material to act as a susceptor in use.

Figure 5:
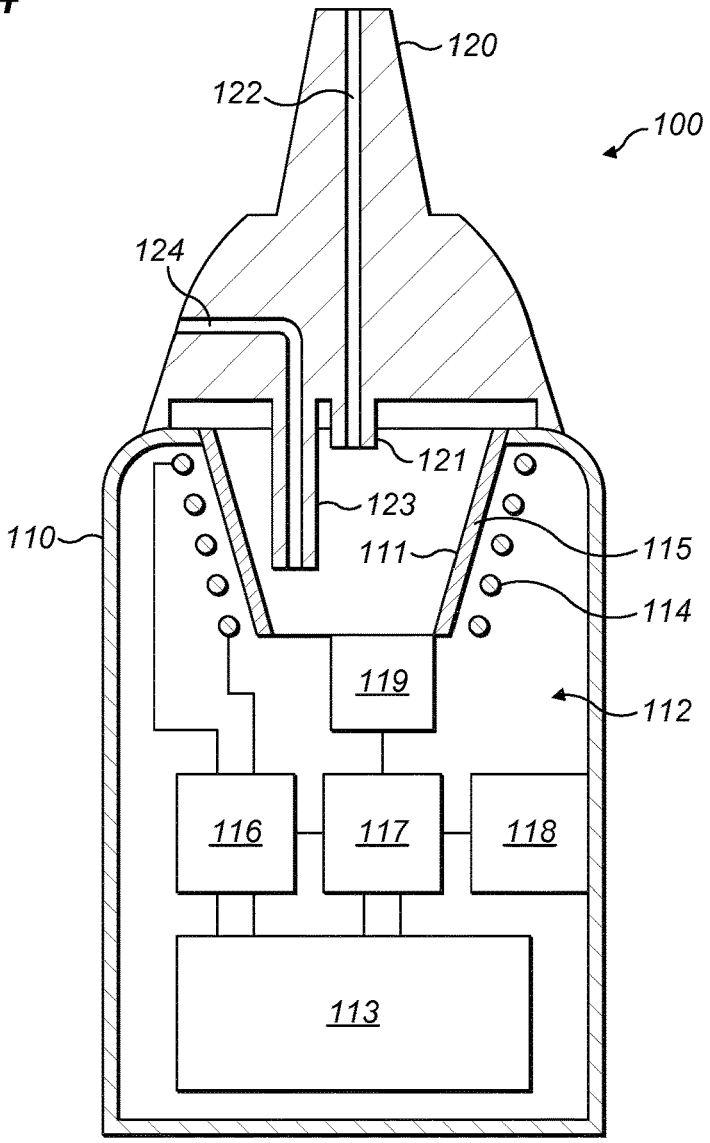
FIG. 5 shows a schematic cross-sectional view of an example of an apparatus for heating smokable material to volatilize at least one component of the smokable material.

Referring to FIG. 5 there is shown a schematic cross-sectional view of an example of apparatus for heating smokable material to volatilize at least one component of the smokable material, according to an embodiment of the disclosure. The apparatus 100 of this embodiment is usable with the article 1 and variants thereof discussed above with reference to FIGS. 1 and 2. Broadly speaking, the apparatus 100 comprises an interface 111 for cooperating with the cartridge 1, a magnetic field generator 112 comprising a coil 114 for generating a varying magnetic field for penetrating the article 1 when the interface is cooperating with the article 1, and a device 121 for puncturing the article 1.

The apparatus 100 of this embodiment comprises a body 110 and a mouthpiece 120. In this embodiment, the body 110 comprises the interface 111, and the interface 111 comprises a recess 111 for receiving at least a portion of the cartridge 1. In other embodiments, the interface 111 may be other than a recess, such as a shelf, a surface, or a projection, and may require mechanical mating with the cartridge 1 in order to co-operate with the cartridge 1.

In this embodiment, the mouthpiece 120 is releasably engageable with the body 110 so as to connect the mouthpiece 120 to the body 110. In other embodiments, the mouthpiece 120 and the body 110 may be permanently connected, such as through a hinge or flexible member.

In this embodiment, the mouthpiece 120 comprises the device 121 for puncturing the seal 30 of the cartridge 1. In this embodiment, the device 121 for puncturing the seal 30 comprises a first tube 121, which may have a sharpened or angled end for facilitated puncturing of the seal 30. The mouthpiece 120 has a first channel 122 extending therethrough, and the interior passageway of the first tube 121 forms a part of the first channel 122. The mouthpiece 120 is locatable relative to the body 110 so as to cover an opening into the recess 111. When the mouthpiece 120 is so located relative to the body 110, the first channel 122 of the mouthpiece 120 is in fluid communication with the recess 111. In use, the first channel 122 acts as a passageway for permitting volatilized material to pass from the cavity 14 of the container 10 of a cartridge 1 inserted in the recess 111 to an exterior of the apparatus 100.

The mouthpiece 120 may comprise or be impregnated with a flavorant. The flavorant may be arranged so as to be picked up by hot aerosol as the aerosol passes through the first channel 122 of the mouthpiece 120 in use.

In this embodiment, the mouthpiece 120 has a second device 123 for puncturing the seal 30 of the cartridge 1. In this embodiment, the second device 123 for puncturing the seal 30 comprises a second tube 123, which may have a sharpened or angled end for facilitated puncturing of the seal 30. The mouthpiece 120 also has a second channel 124 extending therethrough in parallel to the first channel 122, and the interior passageway of the second tube 123 forms a part of the second channel 124. When the mouthpiece 120 is located relative to the body 110 so as to cover the opening into the recess 111, the second channel 124 is in fluid communication with the recess 111. In use, the second channel 124 therefore acts as a passageway for permitting air to pass to the cavity 14 of the container 10 of a cartridge 1 inserted in the recess 111 from an exterior of the apparatus 100. Therefore, when the mouthpiece 120 is connected to the body 110 to assemble the apparatus 100, there is defined an overall flow path that extends from the exterior of the apparatus 100, then through the second channel 124, then through the recess 111, then through the first channel 122 to the exterior of the apparatus 100.

In another embodiment, the second device 123 for puncturing the seal 30 of the cartridge 1 and the second channel 124 of the mouthpiece 120 may be omitted. In such an embodiment, the body 110 may have an inlet for admitting air into the recess 111 from an exterior of the apparatus 100. Therefore, when the mouthpiece 120 is connected to the body 110 to assemble the apparatus 100, there is defined an overall flow path that extends from the exterior of the apparatus 100, then through the inlet, then through the recess 111, then through the first channel 122 to the exterior of the apparatus 100. Such an arrangement is usable, for example, with cartridges that have a container 10 for admitting air into the cavity 14 of the container 10 from an exterior of the container 10.

In this embodiment, since the device 121 projects into the recess 111 sufficiently to contact the seal 30 of a cartridge 1 when the cartridge 1 is located in the recess 111 and the mouthpiece 120 is connected to the body 110, the device 121 is for puncturing the seal 30 as the mouthpiece 120 is moved relative to the body 110 when the cartridge 1 is cooperating with the interface 111. In other embodiments, the device 121 this may not be the case. In some embodiments, the device 121 may be located elsewhere on the mouthpiece 120 than in the present embodiment. In some embodiments, the device 121 for puncturing the seal 30 may take a different form and not form any part of a passageway. For example, in some embodiments, the device 121 may be a spike, pin, blade or other projection projecting from the mouthpiece 120. In some embodiments, the device 121 may be part of the body 110, rather than part of the mouthpiece 120.

In this embodiment, the body 110 comprises a magnetic field generator 112 comprising an electrical power source 113, a coil 114, a heating element 115, a device 116 for passing a varying electrical current, such as an alternating current, through the coil 114, a controller 117, and a user interface 118 for user-operation of the controller 117.

In this embodiment, the electrical power source 113 is a rechargeable battery. In other embodiments, the electrical power source 113 may be other than a rechargeable battery, such as a non-rechargeable battery, a capacitor or a connection to a mains electricity supply.

The coil 114 may take any suitable form. In this embodiment, the coil 114 comprises a helical coil of electrically-conductive material, such as copper. In some embodiments, the electromagnet 114 comprises a magnetically permeable core around which the coil is wound. Such a magnetically permeable core concentrates the magnetic flux produced by the coil and makes a more powerful magnetic field. The magnetically permeable core may be made of iron, for example. In some embodiments, the magnetically permeable core may extend only partially along the length of the coil 114, so as to concentrate the magnetic flux only in certain regions.

In this embodiment, the heating element 115 is made of heating material that is heatable by penetration with a varying magnetic field. The heating material may comprise one or more of the heating materials discussed above. Other heating material(s) that are heatable by penetration with a varying magnetic field may be used for the heating element 115 in other embodiments.

In this embodiment, the heating element 115 comprises a frusto-conical body, and the coil 114 is located radially outwards of the heating element 115. In this embodiment, the coil 114 follows the shape of the frusto-conical heating element 115, and thus has a diameter that increases in an axial direction of the coil 114.

In this embodiment, the heating element 115 defines the recess 111. In this embodiment, the recess 111 is located radially inwardly of the heating element 115. In this embodiment, the heating element 115 defines a closed circuit of heating material that surrounds the recess 111 and extends around an axis of the coil 114. In other embodiments, such as those in which the heating element 115 is made of a magnetic material, the heating element 115 may have an axially-extending gap or slit formed therein so that the heating element 115 defines an open, or incomplete, circuit rather than a closed circuit.

In this embodiment, the device 116 for passing alternating varying current through the coil 114 is electrically connected between the electrical power source 113 and the coil 114. In this embodiment, the controller 117 also is electrically connected to the electrical power source 113, and is communicatively connected to the device 116. The controller 117 is for causing and controlling heating of the heating element 115. More specifically, in this embodiment, the controller 117 is for controlling the device 116, so as to control the supply of electrical power from the electrical power source 113 to the coil 114. In this embodiment, the controller 117 comprises an integrated circuit (IC), such as an IC on a printed circuit board (PCB). In other embodiments, the controller 117 may take a different form. In some embodiments, the apparatus may have a single electrical or electronic component comprising the device 116 and the controller 117. The controller 117 is operated in this embodiment by user-operation of the user interface 118. The user interface 118 is located at the exterior of the body 110. The user interface 118 may comprise a push-button, a toggle switch, a dial, a touchscreen, or the like.

In this embodiment, operation of the user interface 118 by a user causes the controller 117 to cause the device 116 to apply an alternating electric current across the coil 114, so as to cause the coil 114 to generate an alternating magnetic field. The coil 114 and the heating element 115 are suitably relatively positioned so that the alternating magnetic field produced by the coil 114 penetrates the heating element 115. When the heating material of the heating element 115 is an electrically-conductive material, this may cause the generation of one or more eddy currents in the heating element 115. The flow of eddy currents in the heating element 115 against the electrical resistance of the heating element 115 causes the heating element 115 to be heated by Joule heating. As mentioned above, when the heating element 115 is made of a magnetic material, the orientation of magnetic dipoles in the heating element 115 changes with the changing applied magnetic field, which causes heat to be generated in the heating element 115.

The apparatus 100 of this embodiment includes a temperature sensor 119 for sensing a temperature of the recess 111. The temperature sensor 119 is communicatively connected to the controller 117, so that the controller 117 is able to monitor the temperature of the recess 111. In some embodiments, the temperature sensor 119 may be arranged to take an optical temperature measurement of the recess, interface or cartridge 1, 2, 3. In some embodiments, the cartridge 1, 2, 3 may comprise a temperature detector, such as a resistance temperature detector (RTD), for detecting a temperature of the cartridge 1, 2, 3. For example, the temperature detector may be located in or on the container 10 of the cartridge 1, 2, 3. The cartridge 1, 2, 3 may further comprise one or more terminals connected, such as electrically-connected, to the temperature detector. The terminal(s) may be for making connection, such as electrical connection, with a temperature monitor of the apparatus 100 when the cartridge 1, 2, 3 is in the recess 111 or cooperating with the interface. The controller 117 may comprise the temperature monitor. The temperature monitor of the apparatus 100 may thus be able to determine a temperature of the cartridge 1, 2, 3 during use of the cartridge 1, 2, 3 with the apparatus 100.

On the basis of one or more signals received from the temperature sensor 119 or temperature detector, the controller 117 may cause the device 116 to adjust a characteristic of the varying or alternating current passed through the coil 114 as necessary, in order to ensure that the temperature of the recess 111 remains within a predetermined temperature range. The characteristic may be, for example, amplitude or frequency. Within the predetermined temperature range, in use the smokable material 20 within a cartridge 1, 2, 3 inserted in the recess 111 is heated sufficiently to volatilize at least one component of the smokable material 20 without combusting the smokable material 20. Accordingly, the controller 117, and the apparatus 100 as a whole, is arranged to heat the smokable material 20 to volatilize the at least one component of the smokable material 20 without combusting the smokable material 20. In some embodiments, the temperature range is about 50° C. to about 250° C., such as between about 50° C. and about 150° C., between about 50° C. and about 120° C., between about 50° C. and about 100° C., between about 50° C. and about 80° C., or between about 60° C. and about 70° C. In some embodiments, the temperature range is between about 170° C. and about 220° C. In other embodiments, the temperature range may be other than this range.

A user is able to inhale the volatilized component(s) of the smokable material 20 by drawing the volatilized component(s) through the first channel 122 of the mouthpiece 120. As the volatilized component(s) are removed from the cavity 14 of the container 10 of the cartridge 1, air is drawn into the cavity 14 of the container 10 via the second channel 124 of the mouthpiece 120 and is directed to the closed end of the cavity 14 by the second device 123. This air then permeates the smokable material 20 and exits the cartridge 1 via the first channel 122 of the mouthpiece 120 when the user takes another draw.

In some embodiments, the mouthpiece 120 may include a member (not shown) that would contact the cartridge 1 when the cartridge 1 is in the recess 111, to press the cartridge 1 into the recess 111 and help ensure that the cartridge 1 is correctly positioned relative to the heating element 115. The member may be a resilient member.

In some embodiments of the apparatus, the heating element 115 may be omitted from the body 110 of the apparatus 100 or from the apparatus 100 as a whole. In some such embodiments, the apparatus still comprises a magnetic field generator for generating a varying magnetic field. Such apparatus may be usable with cartridges, such as cartridges 2, 3 and variants thereof discussed above with reference to FIGS. 3 and 4, which comprise heating material that can act in use as a heating element to heat the smokable material 20 therein. In such embodiments, the recess 111 may be defined by one or more parts of the body 110 other than a heating element comprising heating material. In such embodiments, the recess 111 and the coil 114 may be relatively positioned so that the varying magnetic field produced by the coil 114 in use penetrates the recess 111 at a location where the heating material of the cartridge 2, 3 is located when the cartridge 2, 3 is cooperating with the interface. When the heating material of the cartridge 2, 3 is an electrically-conductive material, this may cause the generation of eddy currents in the heating material of the cartridge 2, 3. The flow of such eddy currents against the electrical resistance of the heating material causes the heating material to be heated by Joule heating. When the heating material of the cartridge 2, 3 is made of a magnetic material, the orientation of magnetic dipoles in the heating material changes with the changing applied magnetic field, which causes heat to be generated in the heating material.

The apparatus may provide haptic feedback to a user. The feedback could indicate that heating of the heating material is taking place, or be triggered by a timer to indicate that greater than a predetermined proportion of the original quantity of volatilizable component(s) of the smokable material 20 in the cartridge 1, 2, 3 has/have been spent, or the like. The haptic feedback could be created by interaction of the heating material with the coil (i.e. magnetic response), by interaction of an electrically-conductive element with the coil, by rotating an unbalanced motor, by repeatedly applying and removing a current across a piezoelectric element, or the like.

The apparatus may comprise more than one coil. The plurality of coils could be operated to provide progressive heating of the smokable material 20 in a cartridge 1, 2, 3, and thereby progressive generation of vapor. For example, one coil may be able to heat a first region of the heating material relatively quickly to initialize volatilization of at least one component of the smokable material 20 and formation of vapor in a first region of the smokable material 20. Another coil may be able to heat a second region of the heating material relatively slowly to initialize volatilization of at least one component of the smokable material 20 and formation of vapor in a second region of the smokable material 20. Accordingly, vapor is able to be formed relatively rapidly for inhalation by a user, and vapor can continue to be formed thereafter for subsequent inhalation by the user even after the first region of the smokable material 20 may have ceased generating vapor. The initially-unheated second region of smokable material 20 could act as a filter, to reduce the temperature of created vapor or make the created vapor mild, during heating of the first region of smokable material 20.

In some embodiments, the heating material of the heating element 15 of the apparatus or the heating material of the article may comprise discontinuities or holes therein. Such discontinuities or holes may act as thermal breaks to control the degree to which different regions of the smokable material are heated in use. Areas of the heating material with discontinuities or holes therein may be heated to a lesser extent that areas without discontinuities or holes. This may help progressive heating of the smokable material, and thus progressive generation of vapor, to be achieved.

The heating material may have a skin depth, which is an exterior zone within which most of an induced electrical current and/or induced reorientation of magnetic dipoles occurs. By providing that the heating material has a relatively small thickness, a greater proportion of the heating material may be heatable by a given varying magnetic field, as compared to heating material having a depth or thickness that is relatively large as compared to the other dimensions of the heating material. Thus, a more efficient use of material is achieved. In turn, costs are reduced.

In each of the above described embodiments, the container defines an opening into the cavity, and the cartridge comprises a seal sealing the opening. However, in other embodiments that are respective variations to each of the above embodiments, the seal may be omitted from the container and/or both the seal and the opening may be omitted from the container. In some such embodiments, any portion of the cartridge may be punctured in use. In each of the above described embodiments, the apparatus comprises a device for puncturing the seal of a cartridge. In other embodiments that are respective variations to each of the above embodiments, the device may be for puncturing another portion of the cartridge or a different type of article.

In each of the above described embodiments, the smokable material 20 comprises tobacco. However, in respective variations to each of these embodiments, the smokable material 20 may consist of tobacco, may consist substantially entirely of tobacco, may comprise tobacco and smokable material other than tobacco, may comprise smokable material other than tobacco, or may be free of tobacco. In some embodiments, the smokable material 20 may comprise a vapor or aerosol forming agent or a humectant, such as glycerol, propylene glycol, triactein, or diethylene glycol.

In each of the above described embodiments, the cartridge 1, 2, 3 is a consumable cartridge. Once all, or substantially all, of the volatilizable component(s) of the smokable material 20 in the cartridge 1, 2, 3 has/have been spent, the user may remove the cartridge 1, 2, 3 from the apparatus 100 and dispose of the cartridge 1, 2, 3. The user may subsequently re-use the apparatus 100 with another of the cartridges 1, 2, 3. However, in other respective embodiments, the cartridge 1, 2, 3 may be non-consumable, and the apparatus 100 and the cartridge 1, 2, 3 may be disposed of together once the volatilizable component(s) of the smokable material 20 has/have been spent.

In some embodiments, the apparatus 100 discussed above is sold, supplied or otherwise provided separately from the cartridges 1, 2, 3 with which the apparatus 100 is usable. However, in some embodiments, the apparatus 100 and one or more of the cartridges 1, 2, 3 may be provided together as a system, such as a kit or an assembly, possibly with additional components, such as cleaning utensils.

Embodiments of the disclosure could be implemented in a system comprising any one of the articles discussed herein, and any one of the apparatuses discussed herein, wherein both the apparatus and the article has heating material for heating by penetration with the varying magnetic field generated by the magnetic field generator. Heat generated in the heating material of both the apparatus and the article could be transferred to the smokable material to heat the smokable material.

In order to address various issues and advance the art, the entirety of this disclosure shows by way of illustration and example various embodiments in which the claimed invention may be practiced and which provide for superior apparatus for heating smokable material to volatilize at least one component of the smokable material, superior articles and cartridges for use with such apparatus, and superior systems comprising such articles and such apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A cartridge for use with an apparatus configured to heat smokable material and thereby volatilize at least one component of the smokable material, the cartridge comprising:

a container that defines a cavity, wherein the container defines an opening into the cavity, and wherein the container has one or more apertures extending through the container for admitting air into the cavity from an exterior of the container;

smokable material disposed in the cavity, wherein the cavity holds up to 1 gram of the smokable material, and wherein the smokable material comprises tobacco and one or more humectants;

a seal sealing the opening; and heatable heater material that is configured to, in use, be heated by penetration of a varying magnetic field and to thereby heat the smokable material and volatilize at least one component of the smokable material, wherein the heater material comprises a metal or a metal alloy, and wherein the cartridge further comprises a body disposed within the smokable material, the body comprises the heater material.

2. The cartridge of claim 1, wherein the heater material comprises one or more materials selected from the group consisting of: a magnetic material, and a non-magnetic material.

3. The cartridge of claim 1, wherein the heater material comprises an electrically-conductive material including one or more materials selected from the group consisting of: aluminum, gold, iron, nickel, cobalt, plain-carbon steel, stainless steel, ferritic stainless steel, copper, and bronze.

4. The cartridge of claim 1, wherein the container defines an air flow inlet extending through the container, the air flow inlet configured to admit air into the cavity from the exterior of the container.

5. The cartridge of claim 1, wherein the container is made of porous material configured to admit air into the cavity from an exterior of the container.

6. The cartridge of claim 1, wherein the cartridge includes a temperature detector configured to detect a temperature of the cartridge.

7. The cartridge of claim 1, wherein the seal comprises heater material that is heatable by penetration with a varying magnetic field to heat the smokable material.

8. The cartridge of claim 1, wherein the seal is a film seal.

9. The cartridge of claim 1, wherein the seal comprises a metal foil.

10. The cartridge of claim 1, wherein the seal is permanently affixed to the container.

11. The cartridge of claim 1, wherein the seal is a peelable from the container.

12. A cartridge for use with an apparatus for heating smokable material to volatilize at least one component of the smokable material, the cartridge comprising:

a container that defines a cavity, wherein the container defines an opening into the cavity, and wherein the container has one or more apertures extending through the container for admitting air into the cavity from an exterior of the container;

smokable material disposed in the cavity, wherein the cavity holds up to 1 gram of the smokable material, and wherein the smokable material comprises tobacco and one or more humectants;

a seal sealing the opening;

heatable heater material disposed in the cavity, the heatable heater material configured to, in use, be heated by penetration with a varying magnetic field and to thereby heat the smokable material, wherein the heater material comprises a metal or a metal alloy; and a body disposed within the smokable material, wherein the body comprises the heater material.

13. The cartridge of claim 12, wherein the container comprises a vessel that defines the cavity, and wherein the vessel is formed from non-electrically-conductive material.

14. The cartridge of claim 12, wherein the container comprises a vessel that defines the cavity, and a liner disposed on at least a portion of an interior surface of the vessel, the liner including the heater material.

15. The cartridge of claim 14, wherein the liner is configured to permit air to pass through the liner.

16. A system, comprising:

a thermally-conductive cartridge, the cartridge comprising:

a container that defines a cavity, wherein the container defines an opening into the cavity, and wherein the container has one or more apertures extending through the container for admitting air into the cavity from an exterior of the container;

smokable material disposed in the cavity, wherein the cavity holds up to 1 gram of the smokable material, and wherein the smokable material comprises tobacco and one or more humectants;

a seal sealing the opening; and heatable heater material that is configured to, in use, be heated by penetration of a varying magnetic field and to thereby heat the smokable material and volatilize at least one component thereof, wherein the heater material comprises a metal or a metal alloy, wherein the cartridge further comprises a body disposed within the smokable material, the body comprising the heater material; and an apparatus configured to heat the smokable material and volatilize at least one component of the smokable material, the apparatus including: an interface configured to cooperate with the cartridge; and a magnetic field generator configured to, in use, generate the varying magnetic field.

* * * * *